US011330898B2

(12) United States Patent
Gordon

(10) Patent No.: US 11,330,898 B2
(45) Date of Patent: May 17, 2022

(54) TOOL FOR REMOVING MAKE-UP FROM A BRUSH

(71) Applicant: Ana Gordon, Narre Warren North (AU)

(72) Inventor: Ana Gordon, Narre Warren North (AU)

( * ) Notice: Subject to any disclaimer, the term of this patent is extended or adjusted under 35 U.S.C. 154(b) by 320 days.

(21) Appl. No.: 16/327,012

(22) PCT Filed: Sep. 8, 2017

(86) PCT No.: PCT/AU2017/050982
§ 371 (c)(1),
(2) Date: Feb. 21, 2019

(87) PCT Pub. No.: WO2018/045431
PCT Pub. Date: Mar. 15, 2018

(65) Prior Publication Data

US 2019/0191865 A1 Jun. 27, 2019

(30) Foreign Application Priority Data

Sep. 9, 2016 (AU) ..... 2016903641

(51) Int. Cl.
*A46B 17/06* (2006.01)
*B08B 1/00* (2006.01)

(52) U.S. Cl.
CPC ..... *A46B 17/06* (2013.01); *B08B 1/001* (2013.01)

(58) Field of Classification Search
CPC .... A46B 17/04; A46B 17/1706; B44D 3/125; Y10S 206/818
See application file for complete search history.

(56) References Cited

U.S. PATENT DOCUMENTS

| | | | | |
|---|---|---|---|---|
| 3,167,178 | A | 1/1965 | Saunders | |
| 5,032,188 | A | 7/1991 | Kettle et al. | |
| 5,220,769 | A | 6/1993 | Brown et al. | |
| 8,409,358 | B2 | 4/2013 | Bouix et al. | |
| 8,668,085 | B1 | 3/2014 | Oliver | |
| 9,392,866 | B1 * | 7/2016 | Klinsport | A47K 1/09 |
| 2007/0062823 | A1 | 3/2007 | Anderson | |
| 2008/0098551 | A1 | 5/2008 | Yang | |
| 2011/0108444 | A1 | 5/2011 | Shaughness | |
| 2017/0369342 | A1 * | 12/2017 | Hom | A47L 13/50 |

OTHER PUBLICATIONS

International Search Report dated Nov. 20, 2017 from PCT/AU2017/050982 (4 pages).
Written Opinion of the International Searching Authority dated Nov. 20, 2017 from PCT/AU2017/050982 (5 pages).
Notification of Transmittal of the International Preliminary Report on Patentability dated Oct. 30, 2018 from PCT/AU2017/050982 (4 pages).

* cited by examiner

*Primary Examiner* — Shay Karls
(74) *Attorney, Agent, or Firm* — Crowell & Moring LLP; John C. Freeman

(57) ABSTRACT

A tool for removing make-up from a brush comprising: a main body having two opposite walls defining an opening and a pocket, the main body being deformable to allow i) insertion of the brush through the aperture and ii) manipulation of the internal surfaces of the walls against the brush, wherein at least the internal surfaces of the walls are made of a material that does not shed upon manipulation of the walls against the brush.

6 Claims, 5 Drawing Sheets

TOOL FOR REMOVING MAKE-UP FROM A BRUSH

This application is a National Stage application of International Application No. PCT/AU2017/050982, filed Sep. 8, 2017, the entire contents of which are incorporated herein by reference.

FIELD

The present invention relates to a tool for removing make-up from a brush, a method of removing make-up from a brush and a method of manufacturing a tool for removing make-up from a brush.

BACKGROUND

Make-up and beauty products can be quite expensive. As such, users are always looking for tips and tricks to increase the effective use and extend the lifetime of such products as much as possible. For example, daily use of a mascara brush exposes the product to air causing unwanted dry product to stick on the wand. Letting brushes sit with product on them for too long can permanently damage the bristles. There are also concerns that dry and old make-up resting on a brush for a long time could cause the proliferation of bacteria that could cause infections, rashes or the like.

A common method of cleaning a mascara brush is to wipe the clumps off with a paper towel or tissue by gently gripping the bristles with the paper towel or tissue and moving the brush back and forth. This method is successful in getting rid of big clumps of dry make-up, however there is a risk that fibers from the tissue will deposit on the brush in the cleaning process. This has the effect of contaminating both the brush and the rest of the make-up product when the brush is reinserted back in the container. Additionally, fibers on the brush are detrimental to homogeneous application of the product by the user.

Some people recommend soaking the mascara wand in hot water to loosen dried make-up. This method, though, has the effect of adding germs to the wand from the water and is not practical for a user away from home. Some other popular methods use cool water to simply wet the brush and then rub the brush with shampoo or soap until the old make-up has started to lift. The brush is then rinsed off the soap and let to dry.

However, by following this method the user will have to wait for a long time before being able to use the wand again as the brushes will need at least a few hours to dry after cleaning.

U.S. Pat. No. 8,409,358 discloses a tool for cleaning a head of a cosmetic or personal care applicator such as a mascara brush. In particular, U.S. Pat. No. 8,409,358 discloses a reusable or disposable tool that cleans a cosmetic or personal care applicator between uses. The cleaning region comprises a passageway having projections, where the brush is inserted for cleaning by action of the projections against the brush. However, the tool is shaped so that the user's hand can be easily come in contact with the make-up while using the tool or disposing of it.

There is a need for an alternative tool.

SUMMARY OF INVENTION

According to one aspect, the present invention provides a make-up removal tool for removing make-up from a make-up brush comprising:

a main body having two opposite walls defining an opening and a pocket, the main body being deformable to allow i) insertion of the brush through the aperture and ii) manipulation of the internal surfaces of the walls against the brush while extracting the make-up brush from the main body to remove make-up from the brush, and wherein at least the internal surfaces of the walls are made of a material that does not shed upon manipulation of the walls against the brush.

In some embodiments, the make-up removal tool further comprises a flap protruding from the opening i) for facilitating insertion of the brush and ii) for closing the opening. The material of the internal surfaces of the walls may be waxy paper or nonwoven material, such as Tyvek®.

The main body may be formed in a rectangular shape or alternatively may be formed in a triangular shape.

According to a second aspect, the present invention provides a method of removing make-up from a make-up brush comprising:

inserting the make-up brush into a deformable tool having two opposite walls defining an opening and a pocket, and manipulating the internal surfaces of the walls against the brush while extracting the make-up brush from make-up removal tool, wherein at least the internal surfaces of the walls are made of a material that does not shed upon manipulation of the walls against the brush.

Advantageously, in this way the user can clean the brush avoiding getting the fingers in contact with the brush and with the make-up.

The method may further comprise closing the opening of the tool with a flap protruding from the opening.

Disclosed herein there is also a method of manufacturing a tool for removing make-up from a brush comprising:

at least partially overlapping a first piece of material and a second piece of material to form overlapped portions of the first piece of material and the second piece of material, heat sealing segments of the overlapped portions to form one or more tools, each tool comprising a main body having two opposite walls defining an opening and a pocket, the main body being deformable to allow i) insertion of the brush through the opening and ii) manipulation of internal surfaces the walls against the brush, wherein at least the internal surfaces of the walls made of a material that does not shed upon manipulation of the walls against the brush.

The method may further comprise separating the one or more tools.

In some embodiments, the method comprises perforating heat sealed segments of overlapped portions of the first piece of material and the second piece of material to form a sheet of one or more detachable tools.

In some other embodiments, the method comprises cutting the heat sealed segments of overlapped portions of the first piece of material and the second piece of material to form individual tools.

In some embodiments, the first piece of material is integrally formed with the second piece of material and overlapping comprises folding at least part of the first piece of material to overlap at least part of the second piece of material.

In some other embodiments, overlapping comprises laying the first piece of material to overlap at least part of the second piece of material.

In some embodiments, the first piece of material is partially overlapped to the second piece of material so that a remaining part of the second piece of material, upon separation of the tools, provides a flap protruding from the opening i) for facilitating insertion of the brush and ii) for closing the opening.

The material of the internal surfaces of the walls may be waxy paper or nonwoven material, such as Tyvek®.

The main body may be formed in a rectangular shape or alternatively may be formed in a triangular shape.

Advantages and other features of the invention will become apparent from the following drawing, description and claims.

BRIEF DESCRIPTION OF THE DRAWINGS

In order that the invention may be more clearly ascertained, embodiments of the invention will now be described, by way of example, with reference to the accompanying drawing, in which.

DETAILED DESCRIPTION

The present invention relates to a tool 100 for removing make-up from a make-up brush 200 or other cosmetic applicator.

Figures 1A, 1B, 1C:
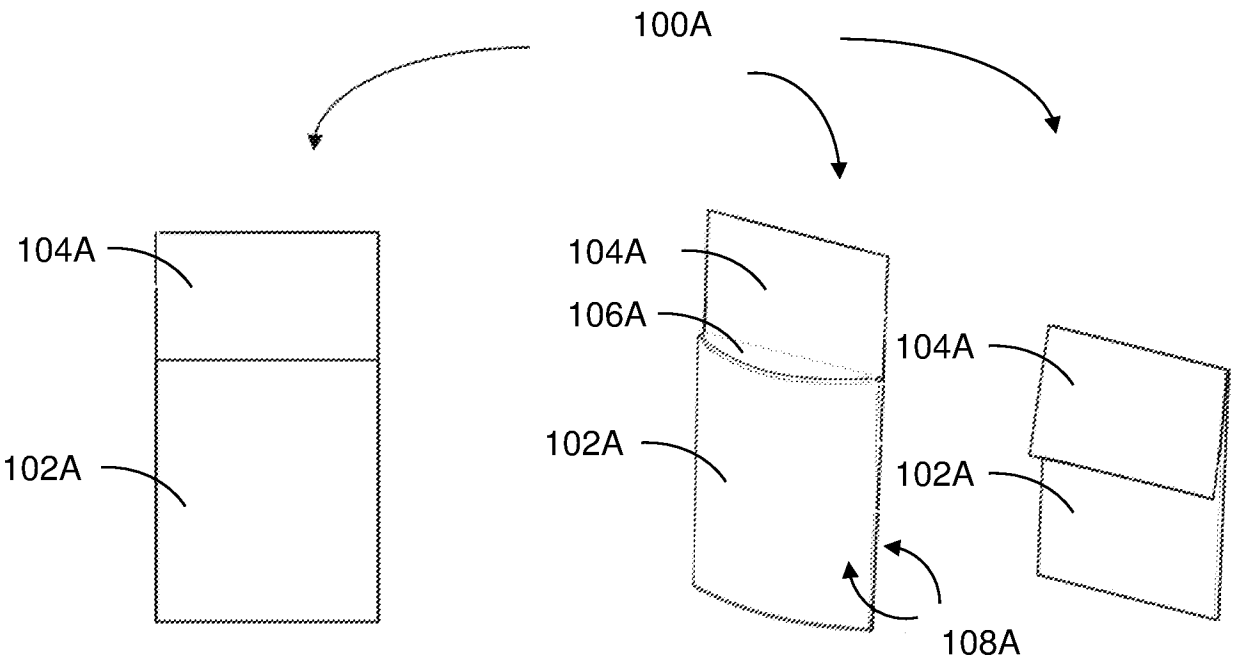
FIG. 1A is a front view of a tool according to a first embodiment of the present invention.
FIGS. 1B and 1C are perspective views of the tool of FIG. 1A in open and closed positions respectively.

FIGS. 1A, 1B and 1C depict the tool 100A according to a first embodiment. Referring to FIG. 1A, the tool 100A includes a main body 102A having two opposite walls 108A defining an opening 106A and a pocket 102A to receive the brush 200 to be cleaned. As evident from FIGS. 1B and 4B the main body 102A is deformable to allow insertion of the brush 200 through the opening 106A and manipulation of the internal surfaces of the walls against the brush 200. At least the internal surfaces of the walls 108A are made of a material that does not shed upon manipulation of the internal surfaces of the walls 108A against the brush 200.

In the described embodiment the tool further comprises a flap 104A protruding from the opening 106A. The flap 104A has the dual purposes of facilitating insertion of the brush 200 into the pocket 102A and closing the opening 106A after the brush 200 is retracted. In this way the removed make-up is captured and retained in the pocket 102A. FIGS. 1C and 4C show indeed the flap 104A folded over the opening 106A to secure the captured make-up inside the pocket 102A. Therefore, the flap 104A provides the user with the extra assurance of avoiding unwanted spillage and leakage of the removed make up.

In other embodiments, the tool does not have a flap.

In the embodiment of FIGS. 1A, 1B and 1C the main body 102A has a rectangular shape. Other shapes, though, may be selected. For example, FIGS. 2A, 2B and 2C depict a tool 100B according to a second embodiment of the invention where the main body 102B is formed in a triangular shape.

Figures 2A, 2B, 2C:
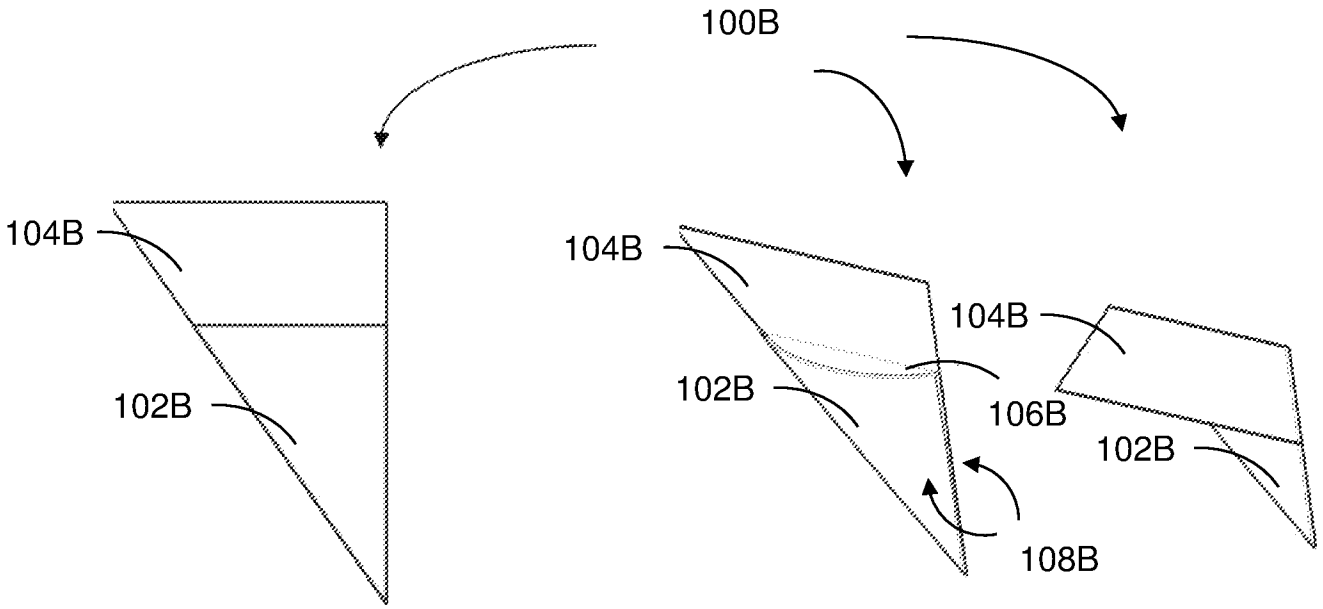
FIG. 2A is a front view of a tool according to a second embodiment of the present invention.
FIGS. 2B and 2C are perspective views of the tool of FIG. 2A in open and closed positions respectively.

Referring now to FIG. 2A the tool 100B includes a main body 102B having two opposite walls 108B defining an opening 106B and a pocket 102B to receive the brush 200 to be cleaned. As evident from FIGS. 2B and 5B, the main body 102B is deformable to allow insertion of the brush 200 through the opening 106B and manipulation of the internal surfaces of the walls 108B against the brush 200. At least the internal surfaces of the walls 108B are made of a material that does not shed upon manipulation of the internal surfaces of the walls 108B against the brush 200.

In the described embodiment the tool 100B further comprises a flap 104B protruding from the opening 106B. The flap 104B has the dual purposes of facilitating insertion of the brush 200 into the pocket 102B and closing the opening 106B after the wand 200 is retracted, so that the removed make-up is captured and retained in the pocket 102B. FIGS. 2C and 5C show indeed the flap 104B folded over the opening 106B to secure the captured make-up inside the pocket 102B. In other embodiments, the tool does not have a flap.

Figures 3A, 3B, 3C:
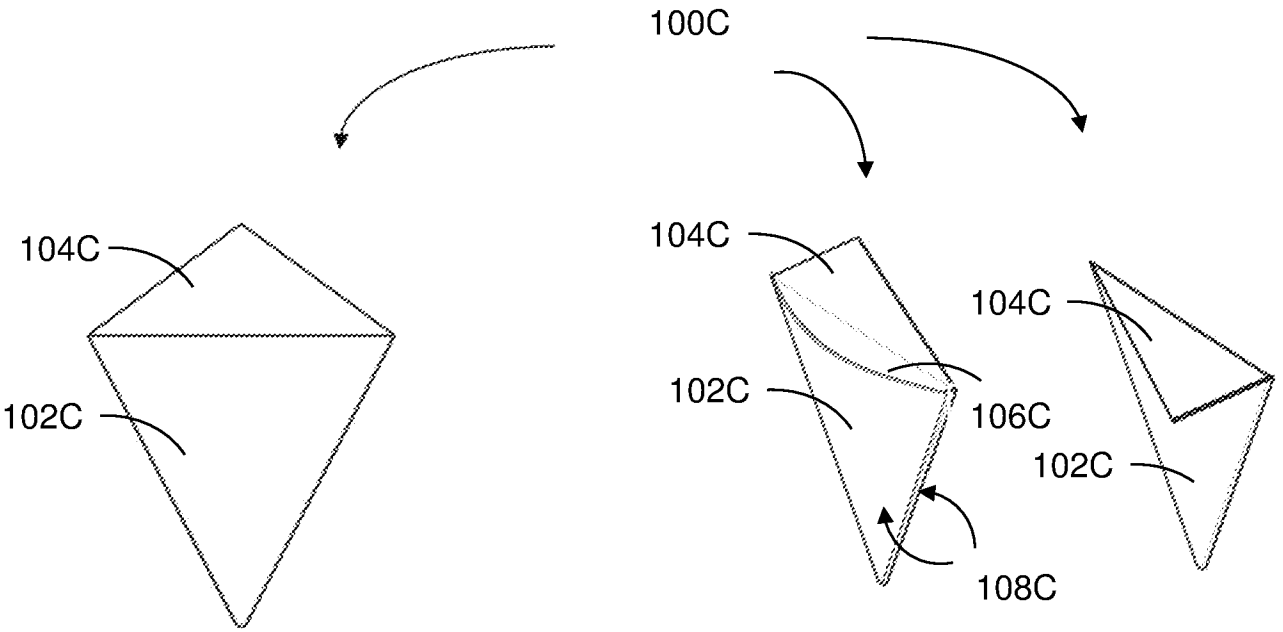
FIG. 3A is a front view of a tool according to a third embodiment of the present invention.
FIGS. 3B and 3C are perspective views of the tool of FIG. 3A in open and closed positions respectively.

Another embodiment of the invention is shown in FIGS. 3A, 3B and 3C, which depict a tool 100C according to a third embodiment, having the main body 102C formed in an isosceles/equilateral triangular shape.

Similarly to the first and second embodiments, referring now to FIG. 3A the tool 100C includes a main body 102C having two opposite walls 108C defining an opening 106C and a pocket 102C to receive the brush 200 to be cleaned. As evident from FIGS. 3B and 6B the main body 102C is deformable to allow insertion of the brush 200 through the opening 106C and manipulation of the internal surfaces of the walls 108C against the brush 200. At least the internal surfaces of the walls 108C are made of a material that does not shed upon manipulation of the internal surfaces of the walls against the brush 200.

In the described embodiment the tool further comprises a flap 104C protruding from the opening. The flap 104C has the dual purposes of facilitating insertion of the brush 200 into the pocket 102C and closing the opening 106C after the brush 200 is retracted so that the removed make-up is captured and retained in the pocket 102. FIGS. 3C and 6C show indeed the flap 104C folded over the opening 106C to secure the captured make-up inside the pocket 102C. In other embodiments, the tool does not have a flap.

As described previously with respect to the embodiments of the tools 100 disclosed in FIGS. 1A-1C, 2A-2C, and 3A-3C and the methods of manufacture of such tools 100 as described hereinafter with respect to FIGS. 7-9, the internal surfaces of opposite walls 108A are not in contact with a standing liquid.

By using the tool 100 according to any of the above described embodiments, the user can get rid of dry make-up from the brush 200 without the risk that fibers from the tool 100 will deposit on the brush 200 in the cleaning process. Additionally, users can avoid getting make-up on their fingers or hands as the brush 200 is contained in the pocket 102 during the cleaning process. As the brush 200 is contained in the pocket 102 during the cleaning process, the risk of make-up dropping from the brush 200 onto clothing or other surfaces is also minimized.

In an embodiment, the entirety of the pocket 102 is made of the same material. In an embodiment, the material of the internal surfaces of the walls 108 is Tyvek®, a synthetic material made of flashspun high-density polyethylene fibers. Tyvek® is produced by DuPont and is a family of tough, durable spunbonded olefin sheet products that are stronger than paper and more cost-effective and versatile than fabrics. The material is very strong; it is difficult to tear but can easily be cut with scissors or a knife.

Other types of material can be selected such as plastic coated paper, waxy paper or other nonwoven materials formed of spunbond olefin fiber.

As evident from FIGS. 4A to 6C the external surface of the pocket 102 can have a pattern applied with any preferred design, logo or the like.

FIGS. 4A to 6C show tools for removing make-up from a brush 200 before, during and after use. The brush depicted in the figures is a mascara wand 200. However, any other make-up brush, wand or applicator can be cleaned using the tool(s) 100 herein described. For example the tool(s) 100 can be used to remove dry or excessive foundation from an applicator.

In order to clean a make-up brush 200 the user inserts the brush 200 into the deformable tool 100, grips the pocket 102, and, manipulates the internal surfaces of the walls 108 against the brush 200 while moving the brush around inside the pocket 102. To maximize removal of the make-up from the brush 200, the user rotates and spins the brush 200 while extracting it from the tool 100. As mentioned above, the internal surface of the pocket 102 is made of a material that does not shed upon manipulation of the walls 108 against the brush 200. The user may remove and reinsert the brush 200 several times until satisfied that sufficient make-up has been removed. This method is convenient, effective and prolongs the life of the product.

Figure 4A:
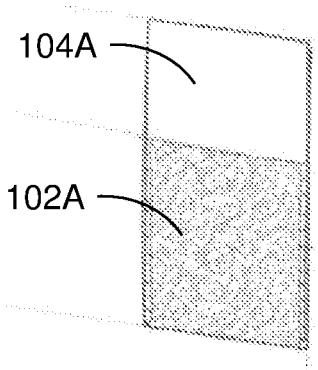
FIGS. 4A, 4B and 4C are views of the tool of FIGS. 1A, 1B and 1C in use.
Figure 4B:
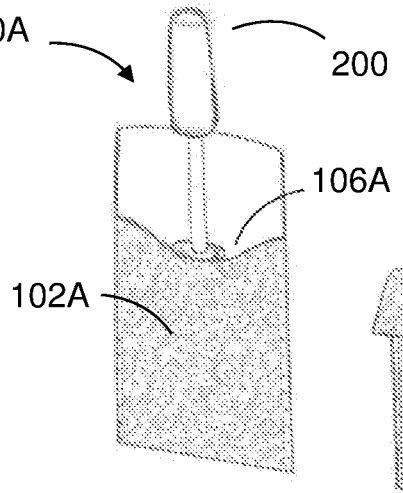
Figure 4C:
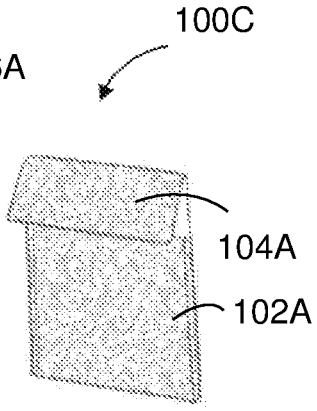

FIG. 4A shows the tool 100A according to the first embodiment ready to be used with the flap 104A open to allow insertion of the brush 200. FIG. 4B depicts a mascara brush 200 inserted in the pocket 102A of the tool 100A. Once the brush 200 is inserted, the user grips the pocket 102A and manipulates the internal surfaces of the walls 108A against the brush 200. FIG. 4C depicts the tool 100A after use with the flap 104A closed to retain the make-up removed from the brush 200.

In the described embodiment the tool 100A also comprises a flap 104A, so that the user, after removing the brush 200 from the main body 102A, can close the opening 106A of the tool 100A with the flap 104A protruding from the opening 106A so that to prevent dispersion of the removed make-up. In an embodiment the tool 100A does not comprise a flap.

Figure 5A:
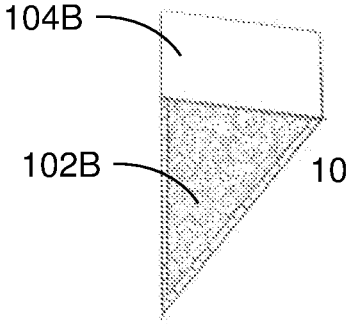
FIGS. 5A, 5B and 5C are views of the tool of FIGS. 2A, 2B and 2C in use.
Figure 5B:
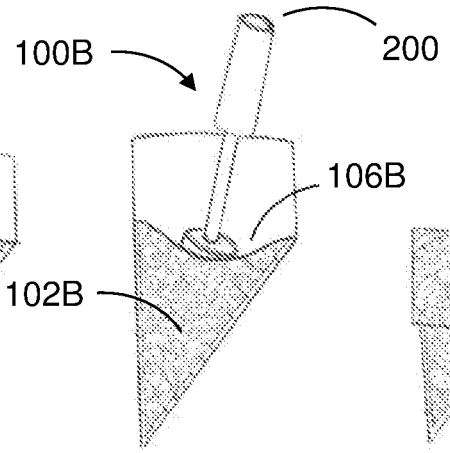
Figure 5C:
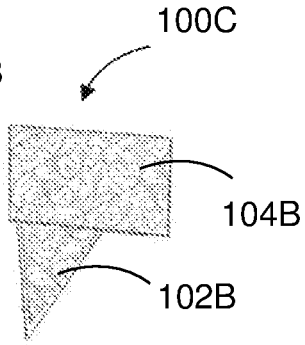

FIG. 5A shows the tool 100B according to the second embodiment ready to be used with the flap 104B open to allow insertion of the brush 200. FIG. 5B depicts a mascara brush 200 inserted in the pocket 102B of the tool 100B. Once again, after the brush 200 is inserted, the user grips the pocket 102B and manipulates the internal surfaces of the walls 108B against the brush 200. FIG. 5C depicts the tool 100B after use with the flap 104B closed to retain the make-up removed from the brush 200.

In the described embodiment the tool 100B also comprises a flap 104B, so that the user, after removing the brush 200 from the main body 102B, can close the opening 106B of the tool 100B with the flap 104B protruding from the opening 106B so that to prevent dispersion of the removed make-up. In an embodiment the tool 100B does not comprise a flap.

Figure 6A:
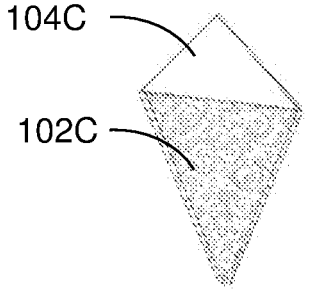
FIGS. 6A, 6B and 6C are views of the tool of FIGS. 3A, 3B and 3C in use.
Figure 6B:
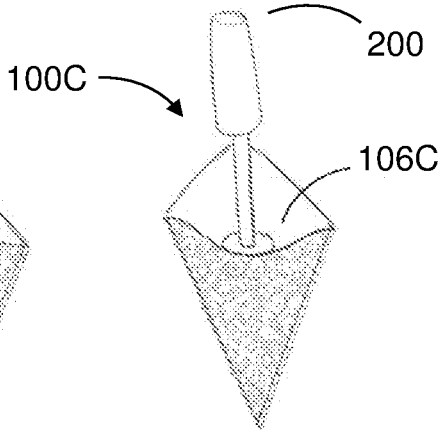
Figure 6C:
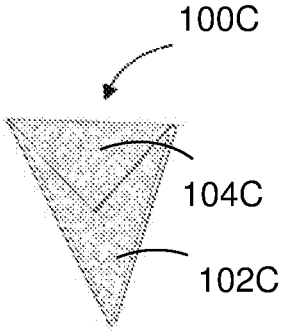

FIG. 6A shows the tool 100C according to the third embodiment ready to be used with the flap 104C open to allow insertion of the brush 200. FIG. 6B depicts a mascara brush 200 inserted in the pocket 102C of the tool 100C. Similarly to the embodiments above described, once the brush 200 is inserted, the user grips the pocket 102C and manipulates the internal surfaces of the walls 108A against the brush 200. FIG. 6C depicts the tool 100C after use with the flap 104C closed to retain the make-up removed from the brush 200.

In the described embodiment the tool 100C also comprises a flap 104C, so that the user, after removing the brush 200 from the main body 102C, can close the opening 106C of the tool 100C with the flap 104C protruding from the opening 106C so that to prevent dispersion of the removed make-up. In an embodiment the tool 100C does not comprise a flap.

Figure 7:
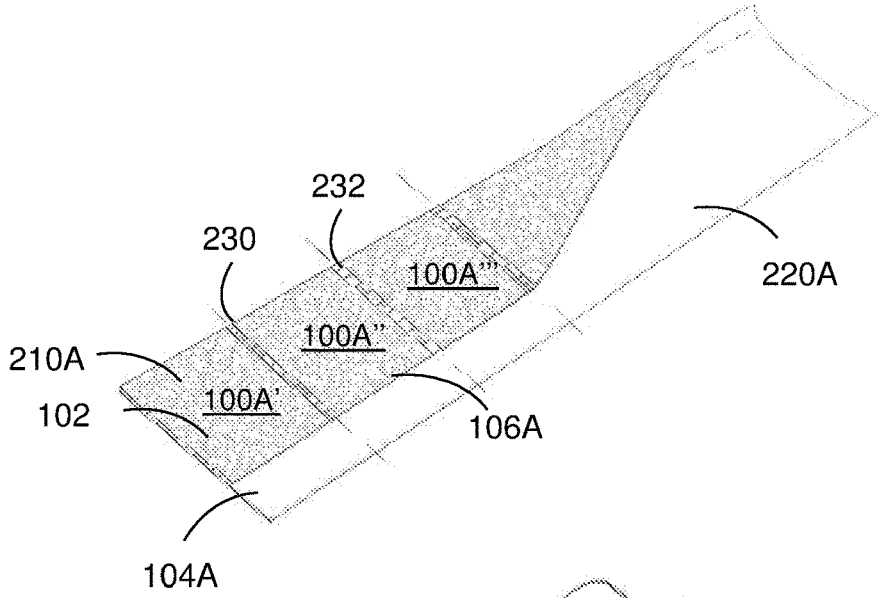
FIG. 7 illustrates a method of manufacturing the tool of FIGS. 1A, 1B, 1C, 4A, 4B and 4C.
Figure 8:
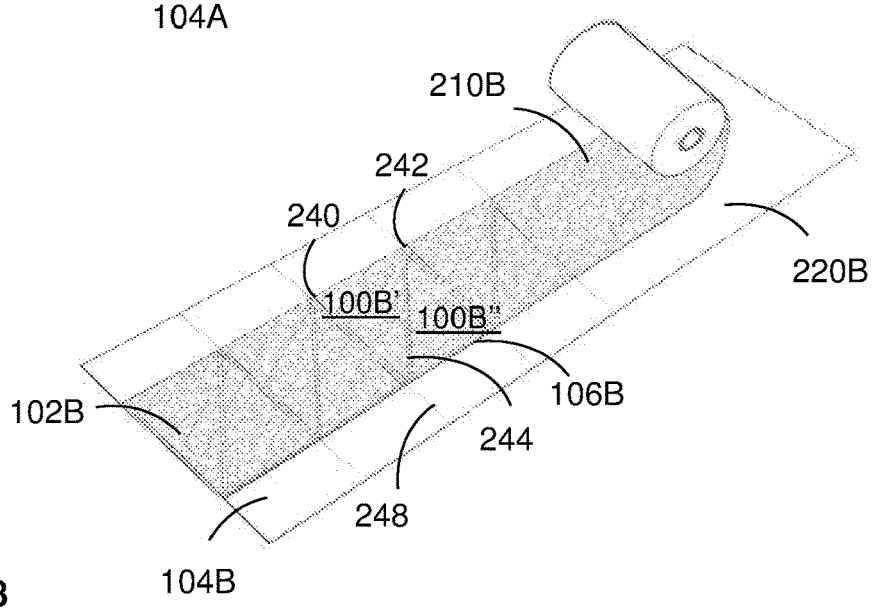
FIG. 8 illustrates a method of manufacturing the tool of FIGS. 2A, 2B, 2C, 5A, 5B and 5C.
Figure 9:
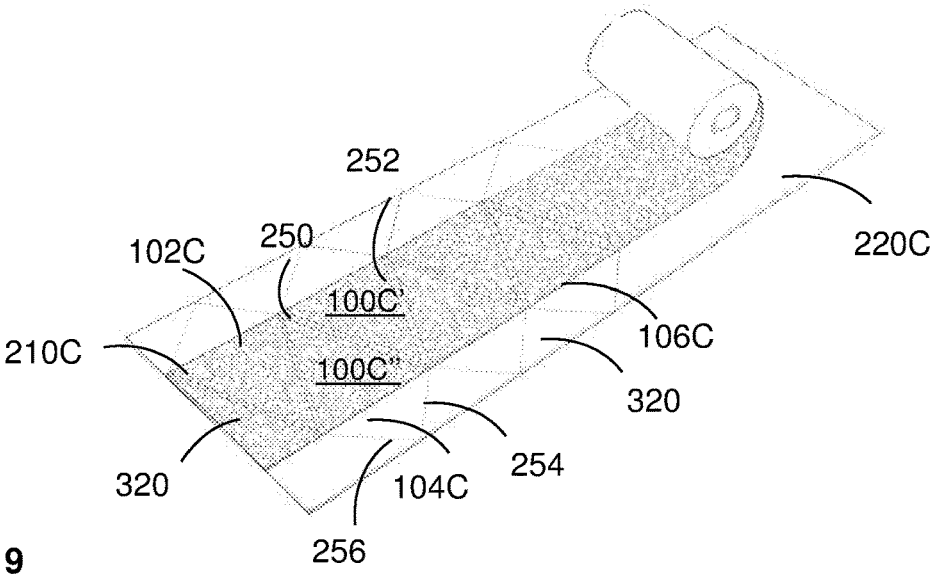
FIG. 9 illustrates a method of manufacturing the tool of FIGS. 3A, 3B, 3C, 6A, 6B and 6C.

FIGS. 7 to 9 illustrate methods of manufacturing the tools 100.

In general, manufacturing the tool 100 is carried out by overlapping at least partially a first piece of material 210 and a second piece of material 220 and by heat sealing segments 230 of overlapped portions of the first piece of material 210 and the second piece of material 220 to form one or more tools 100.

As mentioned above, the internal surface of the pocket 102 is made of a material that does not shed upon manipulation of the walls against the brush 200. A suitable material is for example is Tyvek®. Heat-sealing can be used to melt Tyvek® and cause it to bond to itself. These types of material are widely available and inexpensive which, in turn, allows for a cost-effective manufacturing of the tool 100.

Other types of material can be selected such as plastic coated paper, waxy paper or other nonwoven materials formed of spunbond olefin fiber. It should be appreciated that in each of the above described embodiments the tool 100 is sealed in at least two sides to create a pocket 102. Heat sealing can be performed along any desired segment so that to form tools 100 having the main body 102 of different shapes.

The heat sealed segments provides a semi-rigid ridge which assists the tool to maintain its shape and configuration during manipulation of the walls 108.

As shown in FIGS. 7 to 9 the surface of the first piece of material 210 and/or the second piece of material 220 can have a pattern applied with any preferred design, logo or the like.

FIG. 7 illustrates a method of manufacturing the tool according to the first embodiment described above. In this embodiment the first piece of material 210A is integrally formed with the second piece of material 220A and overlapping comprises folding at least part of the first piece of material 210A to overlap at least part of the second piece of material 220A.

Heat sealing is performed along segments 230, 232 perpendicular to the folding direction so as to form tools 100A', 100A", 100A'" each having the main body 102A formed in rectangular shape.

After the heat sealing step, the tools 100A', 100A", 100A'" can be separated from each other using different methods. For example, scissors can be used to cut along the heat sealed segments 230,232.

Alternatively, the manufacturing process may comprise perforating the heat sealed segments of overlapped portions of the first piece of material 210A and the second piece of material 220A to form a sheet of one or more detachable tools 100A', 100A", 100A'". The user can tear off an individual tool 100 when wanting to use a tool.

Alternatively, the manufacturing process may comprise cutting the heat sealed segments 230,232 of overlapped portions of the first piece of material 210A and the second piece of material 220A to form individual tools 100A', 100A", 100A'".

The described embodiment shows that in the manufacturing process, the first piece of material 210A is partially overlapped to the second piece of material 220A so that a remaining part of the second piece of material 220A, upon separation of the tools, provides a flap 104A protruding from the opening. The flap 104A is formed by cutting or otherwise separating the tools 100A', 100A", 100A'" along the same line of the heat sealed segments 230, 232, as shown in FIG. 7. In some embodiments the flap 104A can be formed by a separate cutting process in respect of remaining part of the second piece of material 220A (the portion of the second piece of material 220A not overlapped to the first piece of material 210A).

FIG. 8, instead, shows a manufacturing process of the tool 100B of the second embodiment. In this embodiment overlapping comprises laying the first piece of material 210B to overlap at least part of the second piece of material 220B. In this embodiment, heat sealing is performed along segments 240,242 perpendicular to the laying direction and segment 244 transversal to the laying direction so that to form tools 100B', 100B', having the main body 102B of right triangular shape.

Once again, after the heat sealing step the tools 100B', 100B" can be separated from each other using different methods. For example scissors can be used to cut along the heat sealed segments 240,242,244.

Alternatively, the manufacturing process may comprise perforating heat sealed segments of overlapped portions of the first piece of material 210B and the second piece of material 220B to form a sheet of one or more detachable tools 100B', 100B". The user can tear off an individual tool 100B', 100B" when wanting to use a tool.

Alternatively, the manufacturing process may comprise cutting the heat sealed segments 240,242,244 of overlapped portions of the first piece of material 210B and the second piece of material 220B to form individual tools 100B', 100B".

The described embodiment shows that in the manufacturing process the first piece of material 210B is partially overlapped to the second piece of material 220B so that a remaining part of the second piece of material 220B, upon separation of the tools, provides a flap 104B protruding from the opening 106B. The flap 104B is formed by cutting or otherwise separating the tools 100B', 100B" along the same line as the heat sealed segments 240,242 perpendicular to the laying direction and segment 244 transversal to the laying direction, as shown in FIG. 8. In some embodiments the flap 104B can be formed by a separate cutting process in respect of remaining part of the second piece of material 220B (the portion of the second piece of material 220B not overlapped to the first piece of material 210B).

FIG. 9 shows the manufacturing process of the tool 100C of the third embodiment. Similarly to the second embodiment, in this embodiment overlapping comprises laying the first piece of material 210C to overlap at least part of the second piece of material 220C.

Heat sealing is performed along segments 250,252 to form tools 100C', 100C', having a main body 102C of isosceles/equilateral triangular shape.

Once again, after the heat sealing step the tools 100C', 100C" can be separated from each other using different methods. For example scissors can be used to cut along the heat sealed segments 250,252.

Alternatively, the manufacturing process may comprise perforating heat sealed segments of overlapped portions of the first piece of material 210C and the second piece of material 220C to form a sheet of one or more detachable tools 100C', 100C". The user can tear off an individual tool 100C', 100C" when wanting to use a tool.

Alternatively, the manufacturing process may comprise cutting the heat sealed segments 250,252 of overlapped portions of the first piece of material 210C and the second piece of material 220C to form individual tools 100C', 100C".

The described embodiment shows that in the manufacturing process the first piece of material 210C is partially overlapped to the second piece of material 220C so that a remaining part of the second piece of material 220C, upon separation of the tools, provides a flap 104C protruding from the opening 106C. The flap 104C is formed by cutting or otherwise separating the tools 100C', 100C" along the same line of the heat sealed segments 250,252 transversal to the folding direction as shown in FIG. 9. In some embodiments the flap 104C can be formed by can be formed by a separate cutting process in respect of remaining part of the second piece of material 220C (the portion of the second piece of material 220C not overlapped to the first piece of material 210C). The flap 104C of FIG. 9 is formed by cutting along lines 254,256 transverse to the folding direction so that a triangular flap 104C is formed. In some other embodiments cutting can be performed along any desired line of the second piece of material 220 to form flaps of different shapes. As shown in FIG. 9, upon separation of the tools 100C', 100C" waste material 320 is also produced.

In summary the present invention provides a method of cleaning a make-up brush that is simple quick and inexpensive. The method can extend the life of a make-up brush by preventing the brush from getting cluttered with old and dry product which prevent the make-up to be easily and consistently applied on a surface, such as eye lashes.

It is to be understood that the reference to prior art herein does not constitute an admission that such prior art forms a part of the common general knowledge in the art, in Australia or any other country.

In the claims that follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A make-up removal tool for removing make-up from a make-up brush consisting of:

a main body consisting of two opposite walls defining an opening and a pocket, wherein, in use, the main body is deformed to allow insertion of a make-up brush through the opening and internal surfaces of the two opposite walls are manipulated against the make-up brush while extracting the make-up brush from the main body to remove make-up from the make-up brush, and wherein at least the internal surfaces of the two opposite walls are made of a material that does not shed upon manipulation of the two opposite walls against the make-up brush, and the material of the internal surfaces of the two opposite walls is nonwoven material manufactured under the trademark Tyvek.

2. The make-up removal tool of claim 1, wherein the main body is formed in a rectangular shape.

3. The make-up removal tool of claim 1, wherein the main body is formed in a triangular shape.

4. The make-up removal tool of claim 1, wherein the two opposite walls are joined by a heat seal to provide a semi-rigid ridge which assists the tool to maintain its shape and configuration during manipulation of the walls.

5. The make-up removal tool of claim 1, wherein the internal surfaces of the two opposite walls are not in contact with a standing liquid.

6. A make-up removal tool for removing make-up from a make-up brush consisting of:

a main body consisting of two opposite walls defining an opening and a pocket, and a flap protruding from the opening i) for facilitating insertion of the brush and ii) for closing the opening after extracting the make-up brush, wherein, in use, the main body is deformed to allow insertion of a make-up brush through the opening and internal surfaces of the two opposite walls are manipulated against the make-up brush while extracting the make-up brush from the main body to remove make-up from the make-up brush, and wherein at least the internal surfaces of the two opposite walls are made of a material that does not shed upon manipulation of the two opposite walls against the make-up brush, and the material of the internal surfaces of the two opposite walls is nonwoven material manufactured under the trademark Tyvek.

* * * * *